US012453899B2

(12) United States Patent
Dahl et al.

(10) Patent No.: US 12,453,899 B2
(45) Date of Patent: Oct. 28, 2025

(54) EXERCISE SYSTEM WITH INTEGRATED LIGHT AND HEAT EMITTING LAMP

(71) Applicants: Tera Dahl, Orlando, FL (US); Terese Viessman, Anamosa, OH (US)

(72) Inventors: Tera Dahl, Orlando, FL (US); Terese Viessman, Anamosa, OH (US)

( * ) Notice: Subject to any disclaimer, the term of this patent is extended or adjusted under 35 U.S.C. 154(b) by 135 days.

(21) Appl. No.: 17/944,869

(22) Filed: Sep. 14, 2022

(65) Prior Publication Data

US 2023/0181973 A1 Jun. 15, 2023

Related U.S. Application Data

(60) Provisional application No. 63/288,985, filed on Dec. 13, 2021.

(51) Int. Cl.
*A63B 24/00* (2006.01)

(52) U.S. Cl.
CPC ..... *A63B 24/0075* (2013.01); *A63B 24/0087* (2013.01); *A63B 2225/74* (2020.08)

(58) Field of Classification Search
CPC ..... A63B 24/0075; A63B 24/0087; A63B 2225/74; G16H 40/63; G16H 20/30
See application file for complete search history.

(56) References Cited

U.S. PATENT DOCUMENTS 6,024,760 A * 2/2000 Marchesi ..... A63B 71/0622 607/90
6,409,744 B1 * 6/2002 Marchesi ..... A61F 7/00 607/90
11,904,208 B2 * 2/2024 Washington ..... F24F 5/0089
2006/0240900 A1 * 10/2006 Larsson ..... A63B 69/3694 473/168
2008/0208296 A1 * 8/2008 Smith ..... A41D 27/085 482/1
2016/0310776 A1 * 10/2016 Smith ..... A61H 33/06
2017/0131693 A1 * 5/2017 Shurtleff ..... A63B 23/03541
(Continued)

FOREIGN PATENT DOCUMENTS

AT 12244 U1 * 12/2011
CN 106890441 A * 6/2017 ..... A63B 69/0017
(Continued)

OTHER PUBLICATIONS https://www.dictionary.com/browse/lamp (Year: 2024).*

*Primary Examiner* — Andrew M Kobylarz
(74) *Attorney, Agent, or Firm* — Jason T. Daniel, Esq.; Daniel Law Offices, P.A.

(57) ABSTRACT

An exercise system includes a lamp device having a main body, a plurality of lighting elements and a controller for performing wireless communication. The system includes a platform provider and a mobile application for use with a user interface device. The mobile application includes instructions for allowing a user to select from a library of video exercise routines stored on the platform provider, and to create a customized workout video. The lamp device is communicatively linked to the user interface device and is selectively activated by the platform provider during execution of the workout video to function in a heat producing mode, an infrared mode, a near-infrared mode, a far-infrared mode and a red light therapy mode.

20 Claims, 7 Drawing Sheets

(56) References Cited

U.S. PATENT DOCUMENTS

| | | | | |
|---|---|---|---|---|
| 2018/0360649 | A1* | 12/2018 | Daffer | A63B 71/04 |
| 2021/0291009 | A1* | 9/2021 | Paganini | A63B 71/0622 |
| 2022/0072381 | A1* | 3/2022 | Trehan | G10L 15/22 |
| 2022/0314078 | A1* | 10/2022 | Watterson | A63B 22/02 |
| 2023/0066293 | A1* | 3/2023 | Lee | H04R 1/1008 |
| 2023/0181973 | A1* | 6/2023 | Dahl | G16H 20/30 482/1 |

FOREIGN PATENT DOCUMENTS

| | | | | | |
|---|---|---|---|---|---|
| CN | 115068879 | A | * | 9/2022 | |
| DE | 102018000237 | A1 | * | 7/2019 | |
| WO | WO-2018036139 | A1 | * | 3/2018 | A61H 1/00 |

* cited by examiner

EXERCISE SYSTEM WITH INTEGRATED LIGHT AND HEAT EMITTING LAMP

CROSS-REFERENCE TO RELATED APPLICATIONS

This application claims the benefit of U.S. Application Ser. No. 63/288,985 filed on Dec. 13, 2021, the contents of which are incorporated herein by reference.

TECHNICAL FIELD

The present invention relates generally to the health and fitness industry, and more particularly to an exercise system having a selectively operable light and heat emitting lamp.

BACKGROUND

The statements in this section merely provide background information related to the present disclosure and may not constitute prior art.

Health and medical experts stress the importance of exercising on a regular basis to maintain a healthy lifestyle. To this end, virtually every city across the country has some type of gym or health club facility which offers a multitude of in-person health and fitness programs.

Despite the availability of these facilities, there are many reasons that an individual would rather exercise in a private setting, such as their home or office, for example. Several of the most common reasons include: lack of transportation to or from the gym, financial commitments required by joining a gym, and the requirement to conform to a rigorous and impersonal routine when attending a gym class which is designed to be a "one size fits all" approach.

For each of these reasons, there are many known systems which provide workout equipment and/or exercise routines to individuals that can be performed at home or other such locations. In most instances, these exercise routines comprise a complete workout covering multiple muscle groups that cannot be customized by the user. As such, users wishing to exercise specific body sections (e.g., arms, legs, etc.) must scroll through the general routines until finding the portion covering these areas. Unfortunately, this often results in the user receiving a less than adequate workout.

In addition to the above, it is well known that applying heat to a user undergoing an exercise routine can assist the user to sweat, thus releasing toxins and allowing for better overall results. Moreover, there have been an increasing number of studies showing the benefits of infrared, near-infrared, far infrared and visible red light therapy systems. Indeed, such systems are known to promote healthy skin, and assist in weight loss and recovery.

Accordingly, it would be beneficial to provide an exercise system that can provide a plurality of user-selectable workout routines for use by individuals at any location. The system can include a menu of workout routines geared toward a single muscle group or exercise style that can be individually selected by a user to create a fully customized full or partial body workout. Moreover, it would be beneficial if the system can provide a light and heat emitting lamp that can be selectively activated by the system to provide targeted heat and/or light during the user selected routine.

SUMMARY OF THE INVENTION

The present invention is directed to an exercise system with an integrated light and heat emitting lamp. One embodiment of the present invention can include a lamp device having a main body, a plurality of lighting elements and a controller for performing wireless communication. The system can also include a platform provider for providing a mobile application to a user interface device. The mobile application can include instructions for allowing a user to select from a library of video exercise routines and to create a customized workout video.

In one embodiment, the lamp device can be communicatively linked to the user interface device so as to be controlled by the platform provider during execution of the workout video. The application can include options for allowing a user to manually control the lamp device between a heat producing mode, an infrared mode, a near-infrared mode, a far-infrared mode, and a red-light therapy mode.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
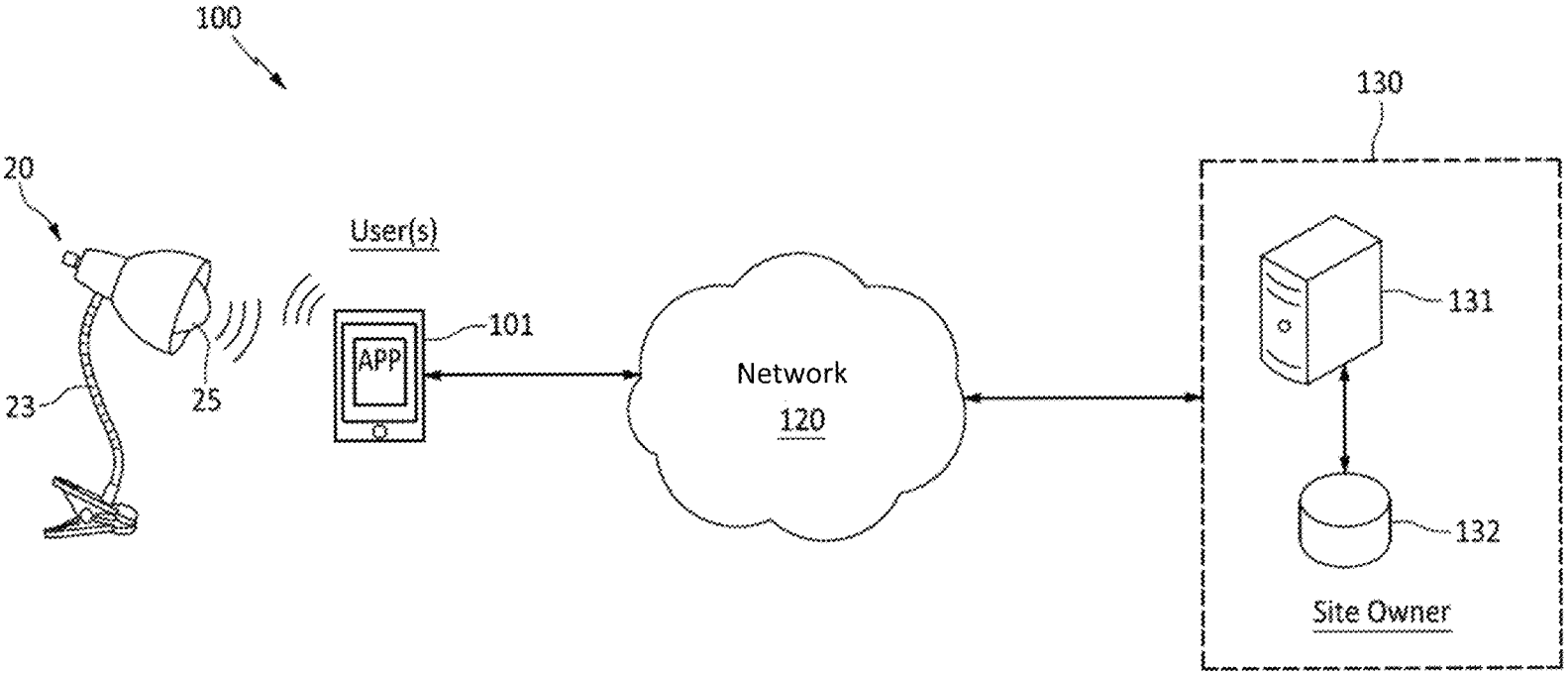
FIG. 1 shows an exemplary environment of an exercise system with integrated light and heat emitting lamp, according to some embodiments of the technology.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure.

Definitions

As described herein, a "unit" means a series of identified physical components and equivalents thereof, which are linked together and/or function together to perform a specified function.

As described herein, the term "user" can include any person utilizing the below described exercise system to create or perform a workout routine.

As described herein, the term "platform provider" can be used to describe any individual, group or legal entity that is providing the below described exercise system to users.

FIG. 1 is a schematic illustration of an exemplary operating environment 100 for implementing the exercise system. In one embodiment, the system 100 can include at least one user interface device 101, and at least one heat and lighting lamp device 20, that can be connected over a network 120 with the platform provider system 130.

The network 120 can be any type of network, including a cellular network, local area network ("LAN"), such as an intranet, a wide area network ("WAN"), the internet, and/or any other type of data transmission and reception medium.

Each of at least one interface device 101 can be any type of computing device that is operable by a human user. A computing device refers to any device with a processor and memory that can execute instructions and communicate with another device. Computing devices include, but are not limited to, smartphones, tablet computers, personal computers, laptop computers and/or purpose-built machines that are pre-encoded with an application interface, so as to perform the functionality so described.

In the preferred embodiment, the user interface device will be a user-owned smartphone; however other embodiments are contemplated wherein the user interface device 101 is a purpose build device that is provided to the user by the platform provider as a part of the system architecture. To this end, some embodiments are contemplated wherein the user interface device can be integrated into an exercise apparatus such as an exercise bike or treadmill, for example.

In either instance, the user interface device can include one or more client applications, such as a web browser, and/or an application interface, for example, which can allow the device to communicate with the platform provider system 130.

In one embodiment, the system can include a mobile application (App) 15 that can be installed on the user interface device so as to send and/or receive information with the lamp device 20. Of course, the inventive concepts disclosed herein are not to be construed as limiting to a smartphone App, as virtually any type of instruction sets, in any form of programming language that can be executed on any type of user interface device 101 are also contemplated.

The platform provider system 130, according to one embodiment, can include one or more individual computing devices 131 that can be connected to one or more databases 132 on which various portions of the below described methodology can be performed. The platform provider system 130 can function to provide a central hub for controlling the communication between the interface device 101 of each system user through any number of different mediums such as a website or mobile application, for example. In this regard, one or more of the individual computing devices 131 can include various web servers, email servers, application database servers and so forth.

The database 132 can function to store any type of data, including the system operating instructions for facilitating communication between the device components, instructions for operating the light and heat producing lamp, and/or generating presentation screens containing instructions and/or videos of exercise routines for execution on the user interface device. To this end, the database can include any type of computer-readable storage mediums, including all forms of volatile and non-volatile memory such as, for example, semiconductor memory devices, e.g., DRAM, SRAM, EPROM, EEPROM, and flash memory devices; magnetic disks, e.g., internal hard disks or removable disks; magneto-optical disks; and optical disks, e.g., CD, DVD, HD-DVD.

In various embodiments, certain aspects of the method and system can be performed in any number of different manners, and can utilize any number of different websites, website URL's and/or computer networks. Additionally, it is contemplated that some of the functionality described herein can also be performed simultaneously via different websites that are directed towards different uses, exercise types, exercise goals and/or geographic locales. Such functionality can be performed under the direct supervision of the platform provider, or via secondary platform providers offering the system functionality through a franchise, licensing, or other type of arrangement with the original platform provider.

As shown in the drawings, the light and heat producing lamp device 20 can include, essentially, a main body 21, having one or more lighting elements 25 that are connected to an internally located system controller 30.

The main body 21 can include any number of different shapes and sizes and can be constructed from any number of different materials that are, for example, relatively strong and stiff for their weight. Several nonlimiting examples include but are not limited to various metals or metal alloys (e.g., aluminum, steel, titanium, or alloys thereof), plastic/polymers (e.g., high-density polyethylene (HDPE), rigid polyvinyl chloride (PVC), or polyethylene terephthalate (PET)), and/or various composite materials (e.g., carbon fibers in a polymer matrix, fiberglass, etc.).

In various embodiments, the main body can include a stand 22 and/or a mounting assembly 23 for securement onto any number of secondary objects so as to permit the device 20 to be oriented toward a user while in use. In one embodiment, the stand can include a fixed or removable tripod, and the mounting assembly can include a fixed or removable arm having a spring-loaded clamp, such as an alligator clamp, for example along a distal end. Of course, any number of other components capable of allowing a user to position the lamp at any location and/or to orient the output of the lamp in any desired direction are also contemplated.

As described herein, each of the one or more lighting elements 25 can include, comprise or consist of any type of device or bulb capable of producing heat and/or light in any color and in any of the visible, near-infrared, infrared, far-infrared or other spectrums. Several nonlimiting examples include various incandescent heat lamp bulbs, Light Emitting Diodes, and others for example.

Figure 2:
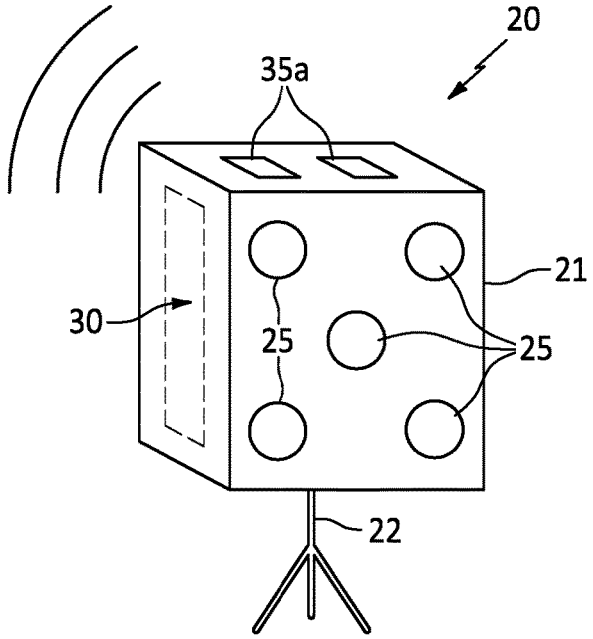
FIG. 2 is a perspective view of the lighting lamp device of the system, in accordance with one embodiment of the invention.

In various embodiments, the device 20 can include a single lighting element 25 (see FIG. 1) or may include a plurality of lighting elements (FIG. 2) so as to form an array. To this end, when including a plurality of different lighting elements 25, each element may be identical, or some of the elements may be different so as to perform different functionality. For example, one plurality of lighting elements may function to generate visible light in any color or intensity, while another may function to produce infrared light, and yet another may function to produce heat at a specific and user-controlled intensity.

The controller 30 can be positioned within the housing 21 and can function to communicate with the user interface device 101 and/or the platform provider system 130, and to control the operation of the lighting units within the device.

Figure 3:
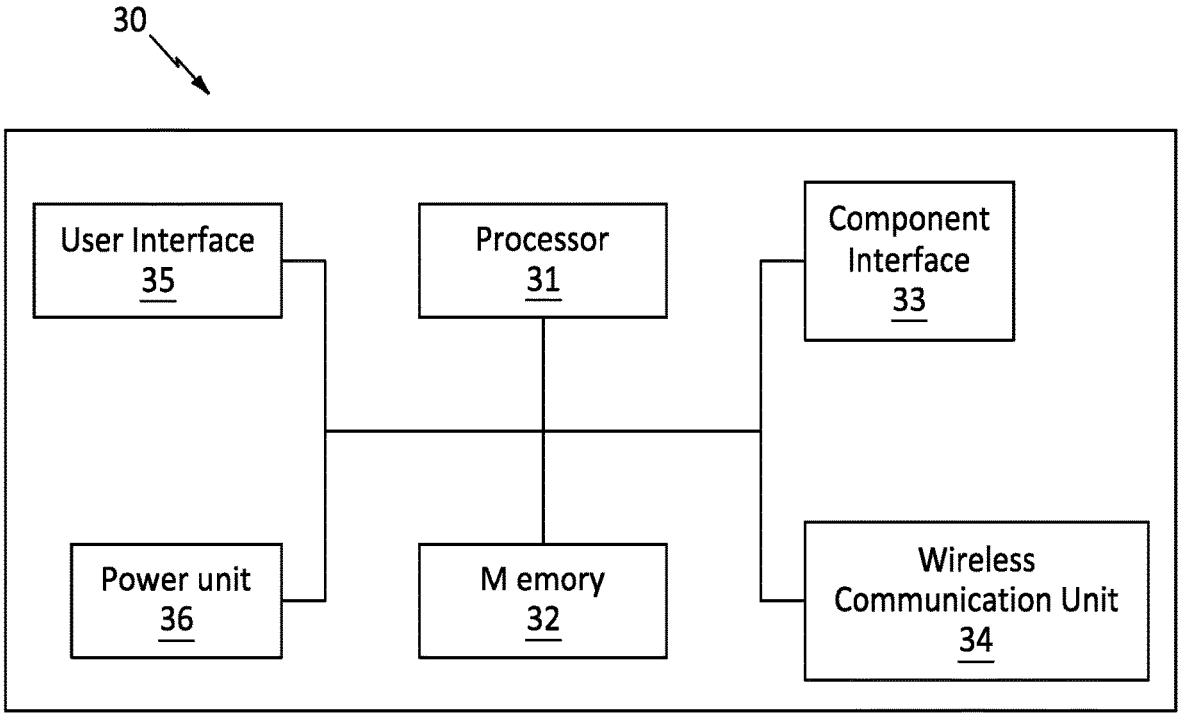
FIG. 3 a simplified block diagram of the lighting lamp device controller of the system, in accordance with one embodiment of the invention.

FIG. 3 is a simplistic block diagram illustrating one embodiment of the controller 30 that includes a processing unit 31 that is conventionally connected to an internal memory 32, a component interface unit 33, a wireless communication unit 34, a user interface 35, and/or a power unit 36.

Although illustrated as separate elements, those of skill in the art will recognize that one or more system components may comprise or include one or more printed circuit boards (PCB) containing any number of integrated circuit or circuits for completing the activities described herein. The CPU may be one or more integrated circuits having firmware for causing the circuitry to complete the activities described herein. Of course, any number of other analog and/or digital components capable of performing the described functionality can be provided in place of, or in conjunction with the described elements.

The processing unit 31 can include one or more central processing units (CPU) or any other type of device, or multiple devices, capable of manipulating or processing information such as program code stored in the memory 32 in order to allow the device to perform the functionality described herein.

Memory 32 can act to store operating instructions in the form of program code for the processing unit 31 to execute. Although illustrated in FIG. 3 as a single component, memory 32 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device such as a hard drive, for example. The bulk storage device can contain any number of different programs that permit the processor to perform the functionality described herein and can also receive and store the exercise information for each user.

The component interface unit 33 can function to provide a communicative link between the processing unit 31 and the lighting elements 25. In this regard, the component interface unit can include any number of different components such as one or more PIC microcontrollers, standard bus, internal bus, connection cables, wireless receiver and/or associated hardware such as USB cables and connectors, and other such hardware capable of linking the various components. Of course, any other means for providing the two-way communication between the system components can also be utilized herein.

The communication unit 34 can include any number of components capable of sending and/or receiving electronic signals with another device, either directly or over a network. In one preferred embodiment, the communication unit 34 can include a Bluetooth transceiver which can communicate with the user interface device 101 via a mobile application (i.e., App) 15, for example, that can be downloaded onto the user device and installed as an application. Of course, the communication unit is not limited to the use of Bluetooth communication, as any number of other transmission and reception mechanisms and protocols can also be utilized herein, several nonlimiting examples include cellular transceivers, Near-Field-Communication (NFC) devices, radio, infrared (IR), RFID, and/or network adapter(s) functioning to communicate over a WAN, LAN, or the internet via an internet service provider, among others, for example.

The user interface 35 can include or comprise any number of physical components capable of sending and/or receiving information with a user. In one embodiment, the user interface can include one or more buttons/switches 35*a*, for example, which can be located along the main body and connected to the processing unit 31 so as to activate different programmatic functions. For example, one such button can act to initiate programming for instructing the processing unit 31 to transition the device between an ON and OFF operating state, to initiate a sleep mode, to pair the communication unit 34 with an external device, and/or to manually operate each of the one or more lighting elements 25.

Of course, the user interface device is not limited to the use of physical buttons, as other embodiments are contemplated wherein the user interface device includes a two-way communicator such as a touchscreen display having a graphic user interface, for example.

The power unit 36 can include any number of different components capable of providing the necessary power requirements to each element of the lamp device. In the preferred embodiment, the power source can include or comprise an A/C electrical power transformer and cord capable of allowing the system to be powered from a standard electrical outlet. Of course, other embodiments are contemplated wherein the power unit includes onboard batteries so as to operate without the need to connect to a power outlet.

Figure 4:
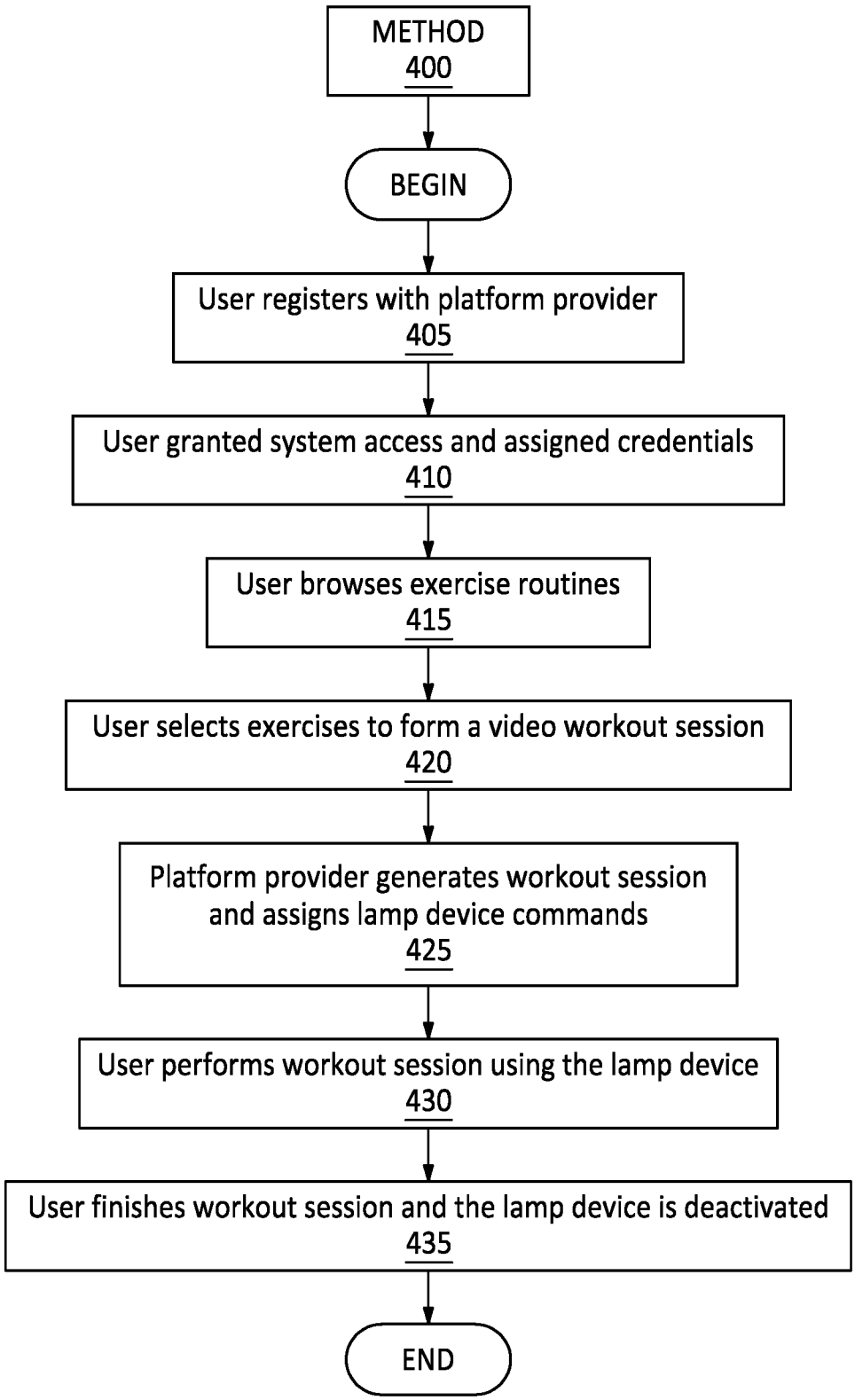
FIG. 4 shows an exemplary flow diagram illustrating a method of using the exercise system with integrated light and heat emitting lamp, according to one embodiment.
Figure 5:
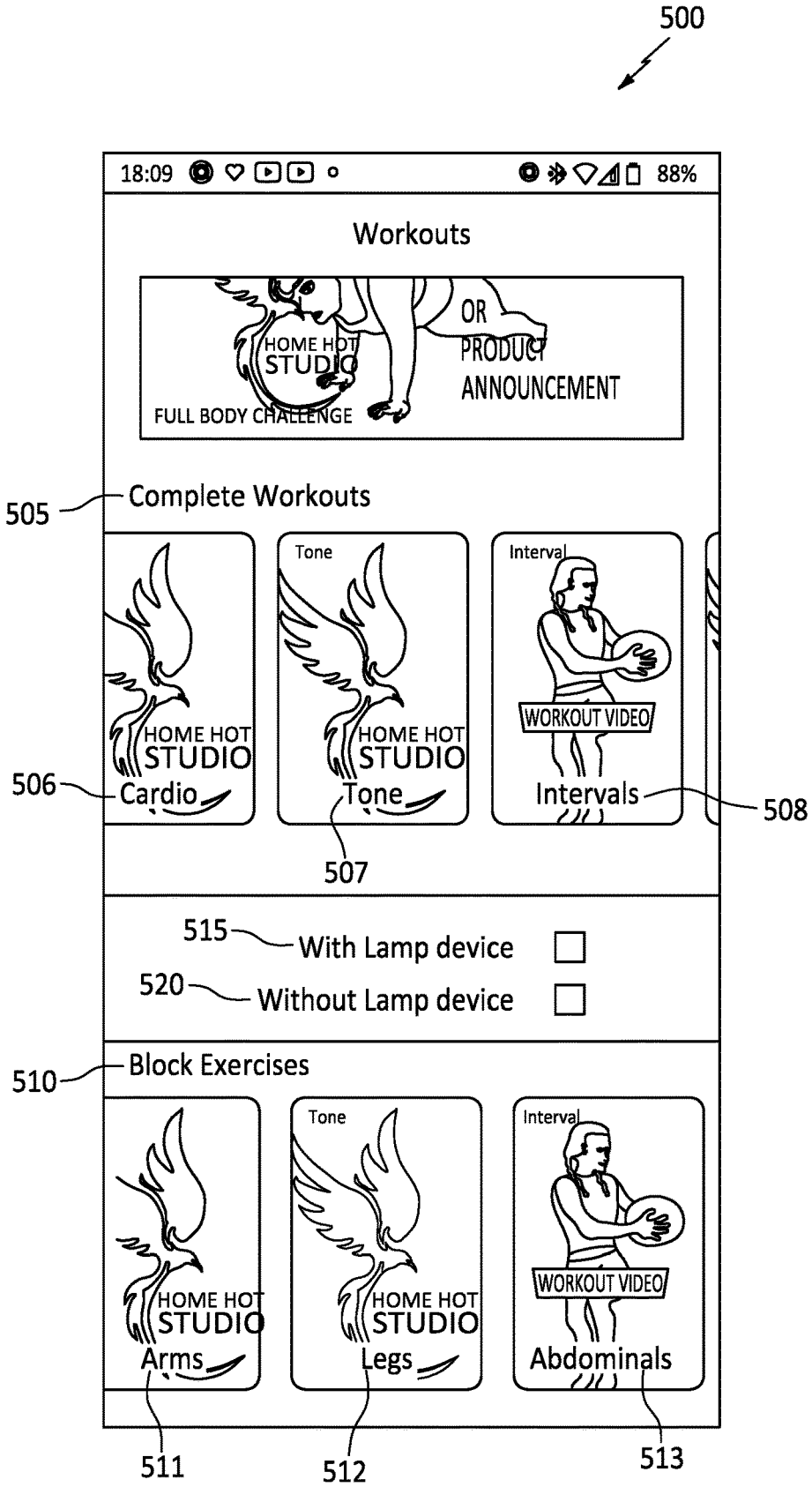
FIGS. 5-7 each show exemplary interface presentation screens of the exercise system with integrated light and heat emitting lamp, in accordance with one embodiment.
Figure 6:
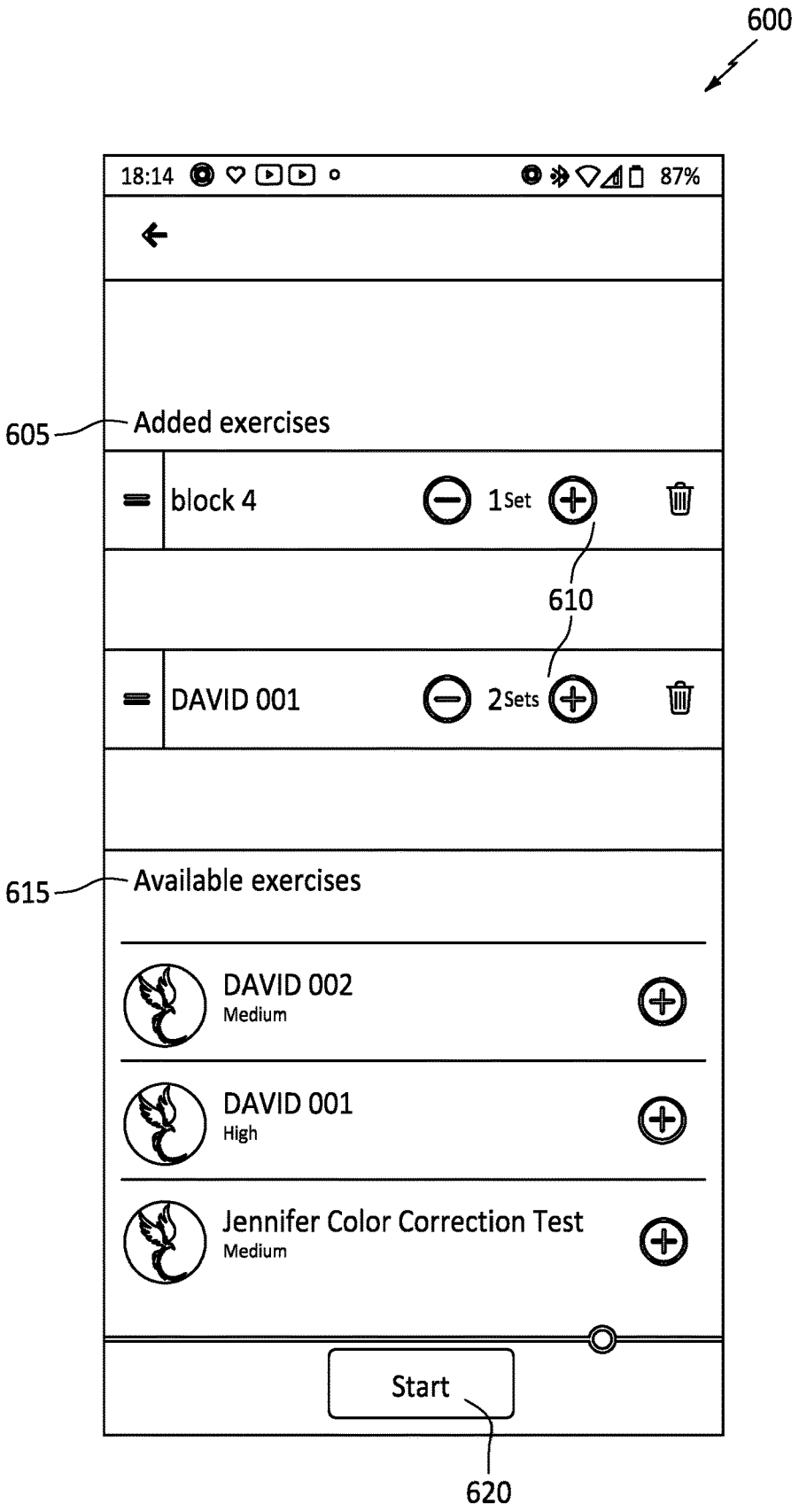
Figure 7:
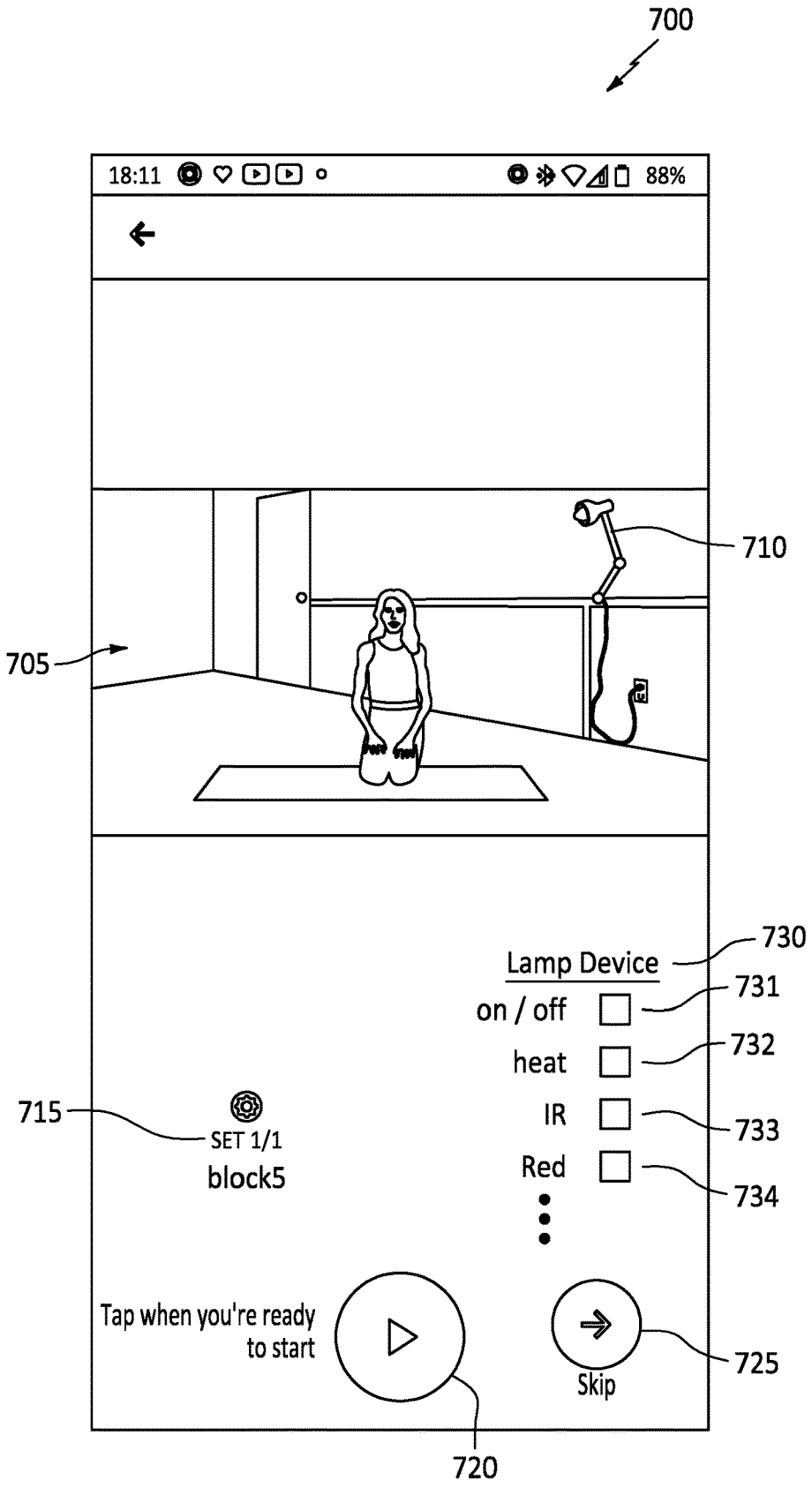

A method of using the exercise system with integrated light and heat emitting lamp will be described with regard to FIG. 4. Moreover, FIGS. 5-7 illustrate several exemplary presentation screens 500-700 illustrating use of the system throughout the method steps. In one embodiment, the below illustrated presentation screens can be generated by the platform provider system 130 for use with the user interface device 101, by, for example, the mobile application 15. Although illustrated in the form of a smartphone and mobile application, this is for illustrative purposes only, as the inventive concepts disclosed herein can be implemented on and across a wide variety of different platforms as described above, without deviating from the scope and spirit of the inventive concepts disclosed herein.

As shown, the method 400 can begin at step 405 wherein the user undergoes a registration process with the platform provider. As described herein, the registration process can include any number of different steps such as providing user identification information, payment information, downloading the mobile application 15 and/or obtaining the lamp device 20, among others, for example. At the conclusion of the registration process, the method can proceed to step 410 wherein the user is assigned a username and password in order to access the workout routines.

Next, the method can proceed to step 415 where the user can browse through a library of available exercise routines stored by the platform provider database. FIG. 5 is an exemplary workout presentation screen 500 that can be produced by the system for execution on the user interface device.

As shown, the screen 500 can include a complete workout section 505 having a plurality of different types of full body exercises such as the cardio 506, tone 507 and Intervals 508 shown. Additionally, the screen can include a block exercise section 510 having a plurality of different types of partial body exercises such as the arms 511, legs 512, and abdominals 513 as shown. Moreover, the screen can allow the user to sort the listing of exercises with 515 or without 520 the lamp device 20.

Although illustrated and described with regard to a certain type or number of exercise routines, this is for illustrative purposes only as the system can provide an unlimited number of different types of exercises and routines.

Next, the method can proceed to step 420 where the user can select and compile a custom video workout session based on the selections provided at step 415. FIG. 6 is an exemplary presentation screen 600 that can be produced by the system for execution on the user interface device. As shown, the screen 600 can include a listing of the selected exercises 605, with options 610 for allowing the user to select the number of repetitions for each selected exercise. Additionally, the system can include an available exercise section 615 which can recommend additional exercises to be added to the workout session based on the users' selections. Once the user has created their workout, the user can select start at 620.

Upon receiving the user command at step 420, the method will proceed to step 425 where the platform provider will create the workout session including a video having each of the user-selected exercises and repetitions/sets. To this end, the platform provider can compile each of the user selected routines into a single video such that each routine segment will seamlessly transition from one to the next.

Based on the users' preferences, some of the selected exercise routines will utilize the lamp device 20 to generate heat, infrared, near-infrared, far infrared and/or visible red light onto the user at predetermined periods within each workout routine. To this end, the platform provider can include instructions for the user interface device to selectively activate the lamp device 20 as the workout session progresses. In one embodiment, the platform provider can instruct the mobile application 15 to use the smartphones onboard Bluetooth transceiver to send and/or receive information with the wireless interface unit 34 of the lamp device.

This information can include a command to activate and deactivate one or more of the lighting elements, to adjust the intensity of one or more of the lighting elements and other such commands throughout the workout. At the conclusion of this step, the platform provider will push the routine to the user device at step 430.

FIG. 7 is an exemplary presentation screen 700 that can be produced by the system for execution on the user interface device. As shown, the screen 700 can include the generated workout session video 705 which includes the user selections provided above. The video can also include instructions 710 for proper placement and alignment of the lamp device 20, along with an identification 715 of what exercise is being performed and options to start/stop 720 and skip 725 the video.

As the video progresses, the lamp device 20 will be selectively and automatically activated by the system to generate one or more of heat, infrared, near-infrared, far infrared and/or visible red light, for example based on the selected exercise. Moreover, screen 700 can include manual lamp device controls 730 for allowing the user to adjust the operation of the lamp device during the workout session such as turning the device on/off 731, activating the heat function 732, activating the IR function 733 and/or activating the red-light function 734 among many others, for example.

Finally, the method can proceed to step 435 where the user can conclude the workout session, and the system can turn off the lamp device and save the finished workout session to the user account for future use.

Of course, the above noted method steps illustrate but one possible utilization of the system functionality and method of usage. As such, many other embodiments are contemplated having any number of different method steps and/or method steps that are performed in a different order than what is described above.

Figure 8:
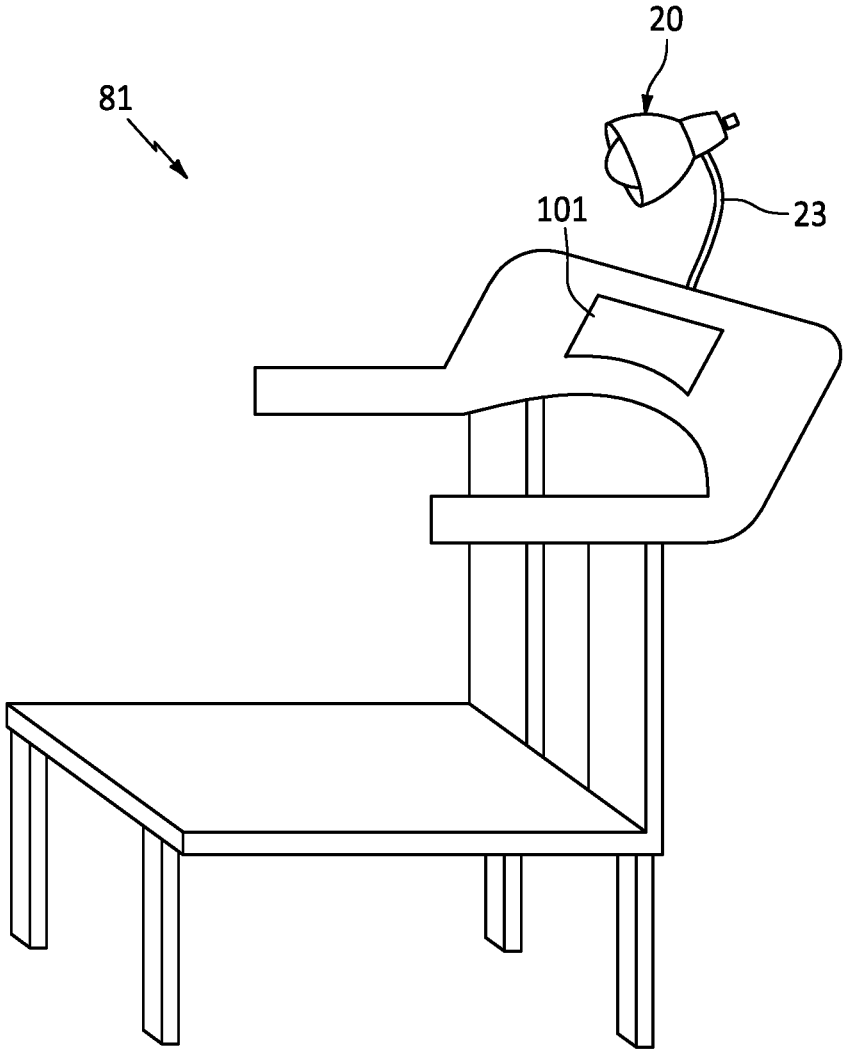
FIG. 8 illustrates one embodiment of the exercise system in operation, in accordance with one embodiment.

Although described above as being a stand alone lamp device 20, other embodiments are contemplated. To this end, FIG. 8 illustrates one embodiment of the lamp 20 being used in conjunction with an exercise machine 81 such as a treadmill. Although illustrated as being connected to the machine via the mounting assembly 23, other embodiments are contemplated wherein the lamp 20 is integrated into the construction of the exercise machine itself. In such an embodiment, the user interface device 101 can also be incorporated into the machine so as to perform the above noted functionality along with directly controlling the operation of the machine. Of course, the inventive concepts are not limited to a treadmill, as any number of different types of machines are contemplated such as a stationary bicycle, an elliptical machine, or rowing machine, among others, for example.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A light therapy exercise system, comprising:

a lamp device having a lamp main body, a lamp mount, and a wireless communication unit;

a user interface device having a body, a display screen and a communication unit; and a platform provider that is configured to communicate with at least one of the lamp device or the user interface device, said platform provider including a database for storing a plurality of video exercise routines, wherein the lamp mount is configured to removably secure the lamp main body onto an object, and wherein each of the user interface device and the lamp device are configured to independently communicate with each other and the platform provider; and the lamp device is selectively activated by the platform provider during execution of a video exercise routine to function in a heat producing mode, an infrared mode, a near-infrared mode, a far-infrared mode, and a red light therapy mode.

2. The light therapy exercise system of claim 1, wherein the platform provider includes functionality for providing the plurality of video exercise routines to the user interface device.

3. The light therapy exercise system of claim 2, further comprising:

a mobile application having a set of programmatic instructions for execution on the user interface device, said mobile application including functionality for communicating directly with the platform provider.

4. The light therapy exercise system of claim 3, wherein the mobile application includes functionality for displaying a library of the plurality of video exercise routines on the user interface device.

5. The light therapy exercise system of claim 4, wherein the mobile application includes functionality for allowing a user to create a video workout session comprising the plurality of video exercise routines from the library.

6. The light therapy exercise system of claim 5, wherein the lamp device is configured to be selectively activated during a playback of at least one of the plurality of video exercise routines on the mobile application installed on the user interface device.

7. The light therapy exercise system of claim 2, wherein the lamp device is configured to be selectively activated during a playback of at least one of the plurality of video exercise routines on the user interface device by each of the user interface device and the platform provider.

8. The light therapy exercise system of claim 7, wherein the lamp device includes at least one lighting element.

9. The light therapy exercise system of claim 8, wherein the at least one lighting element includes a heat lamp bulb.

10. The light therapy exercise system of claim 8, wherein the at least one lighting element is configured to output infrared light.

11. The light therapy exercise system of claim 8, wherein the at least one lighting element is configured to output near-infrared light.

12. The light therapy exercise system of claim 8 wherein the at least one lighting element is configured to output far-infrared light.

13. The light therapy exercise system of claim 8, wherein the at least one lighting element is configured to output visible light.

14. The light therapy exercise system of claim 7, wherein the lamp device includes a plurality of lighting elements within the lamp main body.

15. The light therapy exercise system of claim 14 wherein the plurality of lighting elements includes at least one heat lamp bulb.

16. The light therapy exercise system of claim 14 wherein at least one of the plurality of lighting elements is configured to output infrared light.

17. The light therapy exercise system of claim 14 wherein at least one of the plurality of lighting elements is configured to output near-infrared light.

18. The light therapy exercise system of claim 14 wherein at least one of the plurality of lighting elements is configured to output far-infrared light.

19. The light therapy exercise system of claim 14 wherein at least one of the plurality of lighting elements is configured to output visible light.

20. The light therapy exercise system of claim 1, wherein the lamp mount includes a spring loaded clamp.

* * * * *